United States Patent [19]

Ballarin et al.

[11] Patent Number: 4,462,645

[45] Date of Patent: Jul. 31, 1984

[54] COOLING APPLIANCE, ESPECIALLY A HOUSEHOLD REFRIGERATOR OR THE LIKE

[75] Inventors: Jürgen Ballarin; Detlef Cieslik, both of Giengen; Werner Reichel, Heidenheim, all of Fed. Rep. of Germany

[73] Assignee: Bosch-Siemens Hausgerate GmbH, Stuttgart, Fed. Rep. of Germany

[21] Appl. No.: 344,923

[22] Filed: Feb. 2, 1982

[30] Foreign Application Priority Data

Feb. 6, 1981 [DE] Fed. Rep. of Germany ..... 3104186

[51] Int. Cl.[3] ..... F25D 11/00; E05C 9/06

[52] U.S. Cl. ..... 312/214; 312/322; 312/326; 292/17

[58] Field of Search ..... 312/214, 120, 123, 133, 312/11, 59, 186, 236, 238, 322, 326, 311; 292/17; 16/246, 331, 333, 325

[56] References Cited

U.S. PATENT DOCUMENTS

| | | | |
|---|---|---|---|
| 2,045,013 | 6/1936 | Howland | 312/326 |
| 2,074,546 | 3/1937 | Hartman | 312/326 |
| 2,104,939 | 1/1938 | Whalen | 312/322 |
| 2,414,662 | 1/1947 | Ostrom | 292/17 |
| 2,558,602 | 6/1951 | Atchison | 312/322 |
| 2,955,892 | 10/1960 | Pulaski et al. | 312/326 |
| 3,075,820 | 1/1963 | Humphrey | 312/326 |
| 3,167,186 | 1/1965 | Squire | 312/326 |
| 3,734,551 | 5/1973 | Hughes et al. | 292/17 |
| 3,776,580 | 12/1973 | Michael | 292/17 |
| 4,250,599 | 2/1981 | Nagashima et al. | 292/17 |

*Primary Examiner*—Victor N. Sakran

*Attorney, Agent, or Firm*—Herbert L. Lerner; Laurence A. Greenberg

[57] ABSTRACT

Cooling appliance, including a housing having an opening formed therein, at least one door for sealing the opening, at least one first bearing part fixed on the housing in vicinity of the opening, at least one second bearing part being movably disposed on the first bearing part, at least one supporting tray disposed in the housing and having a given region being disposed on the at least one second bearing part, the supporting tray having a curved portion opposite the given region for permitting the tray to be at least partly swung out of the housing when the door is open, damping means disposed on the tray opposite the housing for damping the impact thereof when swung into the housing, and retaining means disposed on the tray opposite the housing for catching the tray when swung into the housing.

3 Claims, 5 Drawing Figures

COOLING APPLIANCE, ESPECIALLY A HOUSEHOLD REFRIGERATOR OR THE LIKE

The invention relates to a cooling appliance, especially a household refrigerator or the like, having a housing, at least one door sealing the housing, and at least one supporting tray disposed in the housing, the tray having a movable bearing part disposed on a fixed bearing part, which is seated close to the door opening, preferably on the abutting side housing wall, and the tray being curved on the side thereof diametrically opposite the bearing to the extent that with the door open it can be at least partially swung out of the housing.

With known cooling appliances such as these, the supporting frames can be relatively easily swung into the housing so that upon striking the housing, they rebound and again swing partially forward. In this case, there is the danger that with frames loaded with goods to be cooled, these goods can drop off the frame, or that containers in which the goods are kept for cooling can tilt over. Liquids or pourable substances kept in containers can then run out therefrom and thus pollute or render unusable any cooling goods kept in trays therebelow. Another drawback with cooling appliances of the initially described type is that when transporting the cooling appliance, the trays are tossed back and forth or even jump out of the fixed bearing part with accompanying jolts and consequently endanger the cooling appliance.

Aside from this, with known cooling appliances of this type, experience has shown that with the door open the trays tend to automatically swing out from the housing interior if the cooling appliance is not perfectly vertical.

It is accordingly an object of the invention to provide a cooling appliance, especially a household refrigerator or the like, which overcomes the hereinafore-mentioned disadvantages of the heretofore-known devices of this general type, and which protects the trays against impacts that are too hard or automatic swing-outs, by simple means, and in that way to avoid any potential dangers produced thereby.

With the foregoing and other objects in view there is provided, in accordance with the invention, a cooling appliance, comprising a housing having an opening formed therein, at least one door for sealing the opening, at least one first bearing part on the housing in vicinity of the opening, at least one second bearing part being movably disposed on the first bearing part, at least one supporting tray disposed in the housing and having a given region disposed on the at least one second bearing part, the supporting tray having a curved portion opposite the given region for permitting the tray to be at least partly swung out of the housing when the door is open, damping means disposed on the tray opposite the housing for damping the impact thereof when swung into the housing, and retaining means disposed on the tray opposite the housing for catching the tray when swung into the housing.

By means of the damping element according to the invention, an overly hard impact of the tray when pivoting back into the housing is avoided, while the retaining element provides for the locking of the frame in the swung-in position.

In accordance with another feature of the invention, the damping and retaining means are parts of the first and second bearings.

In accordance with a further feature of the invention, the damping means is in the form of a burr disposed on the first bearing part and a resilient elastic synthetic formed part being disposed on the second bearing part and being lockable on the burr.

In accordance with an added feature of the invention, the second bearing part has a hole formed therein facing the first bearing part, and said synthetic formed part has a base in the form of a split rivet disposed in the hole.

In accordance with a concomitant feature of the invention, the formed part has a head opposite the base having a split slot formed therein for engaging the burr.

Other features which are considered as characteristic for the invention are set forth in the appended claims.

Although the invention is illustrated and described herein as embodied in a cooling appliance, especially a household refrigerator or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
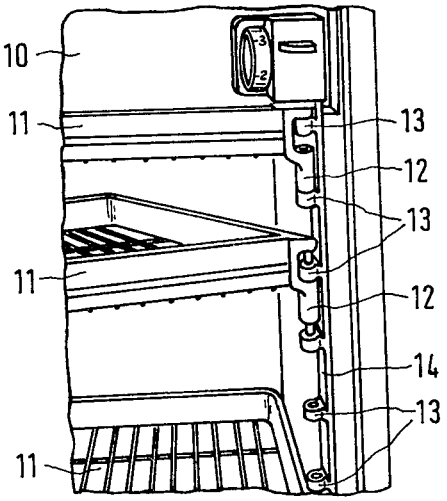
FIG. 1 is a fragmentary, diagrammatic, front elevational view of the doorside of a refrigerator housing, having a plurality of swivelable supporting trays being superposed above each other and being outwardly swingably mounted on a strip, which is equipped with bearing blocks and is seated on the sidewall close to the door opening.

Referring now to the figures of the drawing and first particularly to FIG. 1 thereof, it is seen that reference symbol 10 designates the housing of a household refrigerator, in the interior of which a plurality of supporting trays or frames 11 are disposed. The trays 11 include a wire grid, the edge of which is enveloped by a frame-like border. In the case at hand, the tray 11, which can be swung out of the door opening of housing 10 with the door open, has a movable bearing part 12 at its front corner that is associated with the abutment side of the housing wall. The movable bearing part 12 can be hung or hooked into a fixed bearing part being seated on the abutment side housing wall close to the door opening. The fixed bearing part includes a plurality of bearing blocks 13, which are mutually superposed on each other and are seated together on a continuous strip 14 in the illustrated embodiment. The strip 14 carrying the bearing blocks 13 is mounted on a mounting rail 15, which is disposed on the rear side or inner surface of the inner lining of the housing 10, and is embedded in a rigid-cellular or hard foam synthetic material 16, forming the heat insulation of the housing 10. In this illustrated embodiment, the mounting means used for the strip 14 are countersunk screws 17, the threaded bolts of which are screwed into threaded holes in a cross piece of mounting or bearing rail 15.

Figure 3:
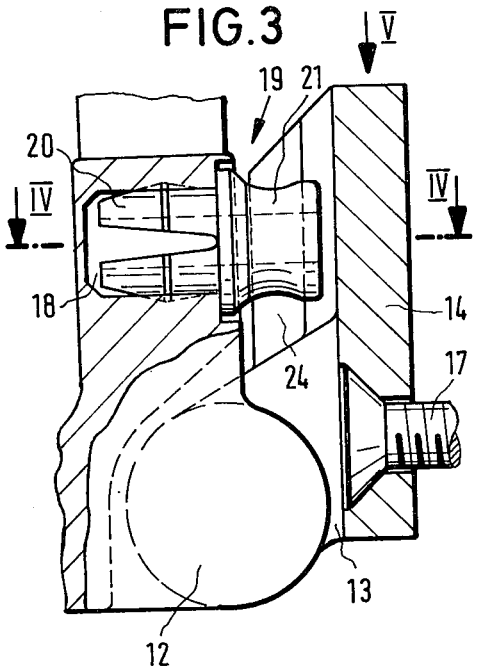
FIG. 3 is another fragmentary, partially cross-sectional view, being partly broken away and still further enlarged as compared to FIG. 2, of the dot-dash circle III in FIG. 2, taken through the strip with a bearing block and the movable bearing part, and a synthetic formed part seated in the movable bearing part to serve as a damping and retaining element.
Figure 2:
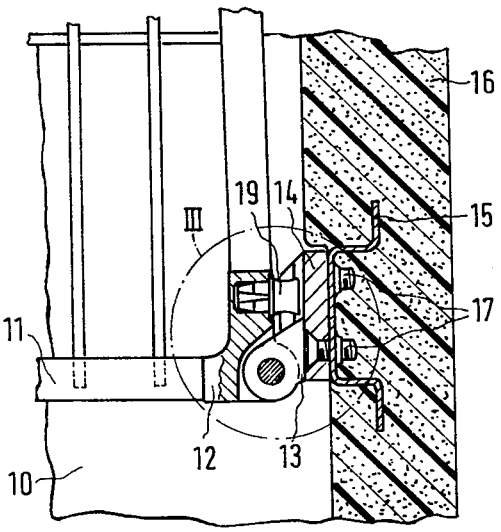
FIG. 2 is a fragmentary, partially cross-sectional view, being partly broken away and being enlarged over that of FIG. 1, through the abutment side housing wall having a fixed bearing part mounted thereon, which in turn has a supporting tray mounted thereon by means of a movable bearing part.

As seen in FIG. 3, a hole 18 is formed in the section of the movable bearing part 12 associated with the rearwardly projecting leg of the supporting tray 11. A synthetic formed part 19 is inserted in the hole 18 to serve as a damping and retaining element, having a base 20 being formed as a recessed split rivet or pin or an expanding cone. The head 21 of the plastic or synthetic formed part 19 laterally projects from the movable bearing part, as is particularly seen in FIG. 4, and is provided with an undercut slot 22 so that two hook-shaped halves are produced, serving as a damping and retaining element. For this purpose, the synthetic formed part 19 is formed of a springy type of plastic or synthetic.

Figure 4:
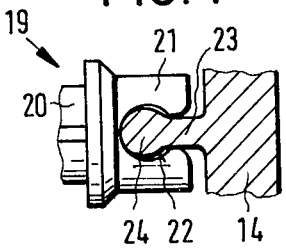
FIG. 4 is a further fragmentary, partially cross-sectional view taken along the line IV—IV in FIG. 3, in the direction of the arrows, through the synthetic formed part and a section of the bearing block.
Figure 5:
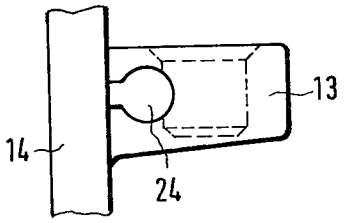
FIG. 5 is a fragmentary top-plan view of a bearing block, as seen along the direction of the arrow V in FIG. 3.

The head 20 of the synthetic formed part 19, serving as a damping and retaining element, interacts with a rib 23 which is seated on the bearing block 13 and extends from there to the rear and has a thickened burr 24 with a nearly circular cross-section, as seen in FIGS. 4 and 5. The width of this thickened burr exceeds that of the undercut opening 22 in the head 20 of the synthetic formed part 19.

The above-described burr 24 on the rib 23 of the bearing block 13 interacts with the synthetic formed part 19 in such a way that the hook-shaped slot sections of the head 20, when approaching the bearing part section associated with the lateral frame part of the supporting tray 11, are spread by the burr 24, and subsequently are locked behind the burr 24 by springy elastic deformation. The movable bearing part 12 locked in this way at the bearing block 13, firmly retains the supporting tray 11 in this position. Thus the supporting tray 11 can be swung out of the housing 10 only after overcoming the retaining force exerted by both hook-shaped halves of the head 21 on the synthetic formed part 19.

By proper dimensioning and material selection, an effective damping and retaining element is created, which prevents the swung-out tray from hitting against the housing wall when swinging back into the housing. In this case, the deformation or strain energy produced by the spreading of both halves of head 21, has a damping effect on the motion of the supporting tray 11.

In this way the tray which is latched as described above onto the bearing block 13 of the fixed bearing part, is locked against both rotational and axial motions. The supporting tray can therefore only be swung out of the housing, by exerting a certain force, and thus is secured against any spontaneous detachment and horizontal swings.

We claim:

1. Cooling appliance, comprising a housing having an opening formed therein, at least one door for sealing said opening, at least one first bearing part fixed on said housing in vicinity of said opening, at least one second bearing part being movably disposed on and at least partially axially insertible into said first bearing part from above, at least one supporting tray disposed in said housing and having a given region being disposed on said at least one second bearing part, said supporting tray having a curved portion opposite said given region for permitting said tray to be swung from a rest position to a position at least partly swung out of said housing when said door is open, a shaped damping element disposed on one of said bearing parts for damping the impact of said tray when swung into said rest position, and a shaped retaining element disposed on the other of said bearing parts for catching said damping element and axially interlocking said bearing parts when said tray is swung into said rest position.

2. Cooling appliance according to claim 1, wherein said damping element is in the form of a burr disposed on said first bearing part and said retaining element is in the form of a resilient elastic synthetic formed part being disposed on said second bearing part and being lockable on said burr with a substantially C-shaped opening formed in said retaining element.

3. Cooling appliance according to claim 2, wherein said second bearing part has a hole formed therein facing said first bearing part, and said synthetic formed part has a base in the form of a split rivet disposed in said hole.

* * * * *